US006189457B1

(12) United States Patent
Campfield

(10) Patent No.: US 6,189,457 B1
(45) Date of Patent: Feb. 20, 2001

(54) SUPPORT BRACKET FOR DOMESTIC CONTAINERS FOR RAILROAD TRANSPORTATION

(76) Inventor: Frank J. Campfield, 3643 W. 86th Pl., Chicago, IL (US) 60652

( * ) Notice: Under 35 U.S.C. 154(b), the term of this patent shall be extended for 0 days.

(21) Appl. No.: 09/097,747

(22) Filed: Jun. 16, 1998

(51) Int. Cl.[7] ..... B61D 17/00
(52) U.S. Cl. ..... 105/411; 296/40
(58) Field of Search ..... 105/238.1, 396, 105/404, 411; 296/40, 41

(56) References Cited

U.S. PATENT DOCUMENTS 2,679,432 * 5/1954 Ruth ..... 105/411

OTHER PUBLICATIONS

Photographs of repair apparatus for attachment block, believed used by Pines at least as early as Jun. 1, 1997.

* cited by examiner

*Primary Examiner*—S. Joseph Morano
*Assistant Examiner*—Robert J. McCarry, Jr.
(74) *Attorney, Agent, or Firm*—Dick and Harris

(57) ABSTRACT

A support bracket for domestic containers for the transportation of cargo on railcars is provided for giving support, to the attachment blocks which are used by cranes and loaders to pick and manipulate such containers, as well as to the framework members of the container which are adjacent to the attachment block.

3 Claims, 5 Drawing Sheets

SUPPORT BRACKET FOR DOMESTIC CONTAINERS FOR RAILROAD TRANSPORTATION

BACKGROUND OF THE INVENTION

1. The Technical Field

The present invention relates to domestic containers for use in transportation of cargo on railroads, in particular the kind of domestic containers which may be transferred back and forth between truck trailers and railroad cars, and which, when particularly mounted on railroad cars, are stacked in tandem. The present invention, in particular, relates to support brackets for use in repairing and/or reinforcing such domestic containers which have composite material constructions of part metal, part wood or other material.

2. The Prior Art

In addition to dedicated boxcars, tank cars and flat cars, cargo may be transferred via the railroads, using devices which, in the U.S. at least, are commonly known as "domestic containers". Such containers typically have a generally rectangular cross-sectional configuration, and have a composite construction, in which a metal frame is provided, and wood or other materials are used for the panels which form the side, end, top and bottom walls of the container. Typically, the sides and top are steel or aluminum panels and the floor is wood. There is typically a wood liner for the sides. A typical domestic container may have a length of forty eight feet (lengths of 40 feet, 45 feet and 53 feet are also known), a height of nine and one-half feet, and a width of eight and one-half feet. Such a container may have an empty weight on the order of eight to nine thousand pounds, and may have a loaded weight of more than sixty five thousand pounds.

Such containers may be transported both on truck trailers, as well as on specially configured, low profile railroad cars. Typically, when used on such railroad cars, a first domestic container is placed into a well formed into the railroad car. A second domestic container is then stacked atop the first, for efficient loading and use of available space. Such containers are typically not owned by the railroads on which they are used. Instead, such containers are usually leased from other entities.

Manipulation of such domestic containers in a railyard is typically accomplished by cranes or self-propelled loaders which grasp the containers by inserting hooks into attachment apertures formed in metal "blocks" in the frame of each container. Typically, two such blocks are located at opposite sides of the container, at two locations, a short distance from each end of the container. For example, for the example mentioned above, two such attachment apertures may be positioned four feet or thereabout from each end of the container.

These blocks, in which the attachment apertures are located, typically project slightly upwardly and outwardly, relative to the adjacent wall panels of the container. As such, when one container is stacked above another, the weight of the upper container in large part is concentrated through the lower container frame, and in particular, the metal blocks having the attachment apertures. Accordingly, the metal structure of the frame making up and surrounding the blocks receives a disproportionate amount of stress and loading.

The metal of the frames of such domestic containers is typically iron or steel which may not be specially treated or formulated to resist attack from the elements, with the possible exception of a somewhat fragile coating of paint.

The metal then, over prolonged exposure to the elements, is attacked by rust and weakened. Although the containers are made to be watertight, repeated pounding and stresses cause moisture leakage into the interior of the containers, along the seams between the frame and the wall panels, which causes the interior frame members to also be attacked by rust and/or other chemical corrosion, further weakening the structure of the container.

Eventually, the repeated pounding and stresses which such containers encounter, as they are transported, as well as during the railyard handling and stacking, awaiting transport, causes the frame structures of the containers to buckle and fail. Most often, this buckling takes place at one or more locations in the immediate vicinity of the blocks for the attachment apertures. Once this buckling has begun, it progresses quickly, and the container is soon rendered unusable, even though apart from the localized buckling, the rest of the container may be in generally good condition. Such containers have been in use for well over ten years, and the aforementioned buckling phenomenon has been known to occur after only a few years of use of any particular container. So far, an effective solution to restore such containers to utility, for more than a few months at a time, if at all, without totally reconstructing the container, is believed not to have been found, before the present invention.

Because each such container may cost up to twenty five thousand dollars or more to replace, the premature loss of function of each container creates a significant burden on the railroads, in terms of finding usable containers in order to maintain the flow of goods, but also in terms of the amount of money "tied up" in unusable capital. It is believed that at the present time, many thousands of such containers, representing millions of dollars of investment, are idled due to such damage.

Accordingly, it would be desirable to provide an apparatus and method for supporting the structures of such domestic containers, which will enable such containers to be restored to useable condition.

It would also be desirable to provide an apparatus and method for supporting the frame structures of such domestic containers, which may be applied to existing, still usable containers, in order to prevent such containers from becoming prematurely unusable.

Methods are known which have been used in an attempt to restore such containers to useful function. One method which is known is to force the collapsed frame structure, in the vicinity of the block, back into its original shape and then place several sheets or plates of metal around the interior surface of the metal block forming the support for the attachment aperture, like a form of flashing, which covers the area of the block and portions of the adjacent frame structure. Typically, these sheets or plates are all generally flat and are welded together, and to the original metal of the container frame, at the edges where these sheets or plates meet. As such, the flashing provides only limited support to the frame structure, and such repairs have been known to last only a short time before buckling sets in again. This may be due to the fact that the welds between adjacent sheets or plates are subjected to and must withstand considerable bending forces, which the joined, non-integrally formed flashing plates are ill-equipped to do.

SUMMARY OF THE INVENTION

The present invention is directed, in part, to a support bracket for domestic containers for railroad cargo transportation. Specifically, the present invention comprises, in part, a support bracket for the attachment blocks which are formed in the frames of the domestic containers. The support bracket is preferably formed as an angled piece of metal, formed from a single metal blank, and having a side elevation contour, which is substantially the same as the exterior contour of the attachment block. The support bracket will be operably configured to be affixed to both the vertical and horizontal frame structures of the container, which are adjacent to the attachment block. The angled contour of the support bracket will provide vertical support beneath the block, and serve to transfer the forces acting downwardly onto the block into vertical and horizontal forces acting on the vertical and horizontal frame members.

The present invention also comprises a method for affixing the support bracket to a domestic container, as well as a method for repairing a domestic container.

BEST MODE FOR CARRYING-OUT THE INVENTION

Figure 1A:
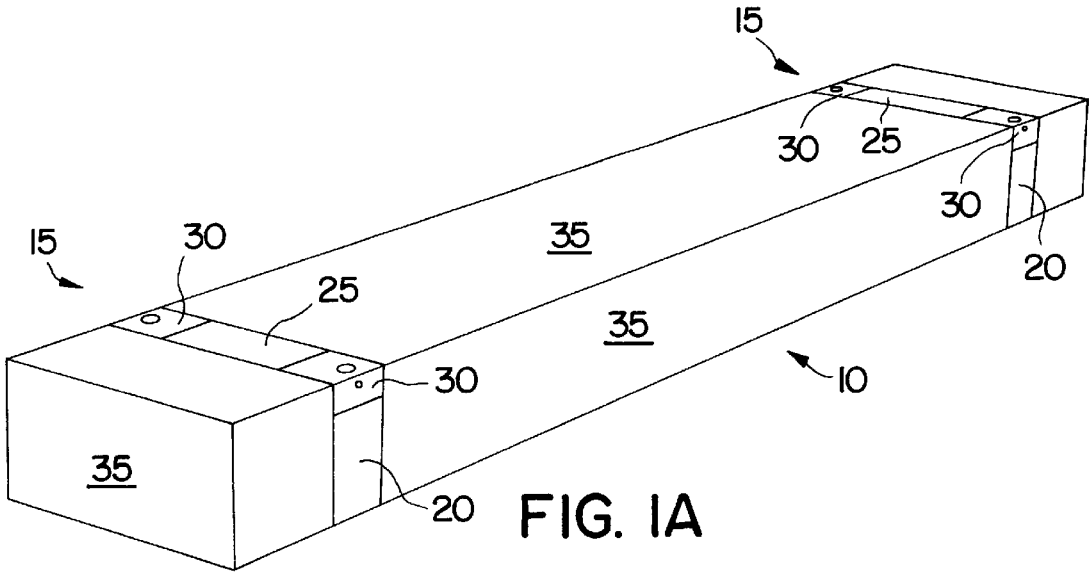
FIG. 1*a* is a perspective view of a typical prior art domestic container.
Figure 1B:
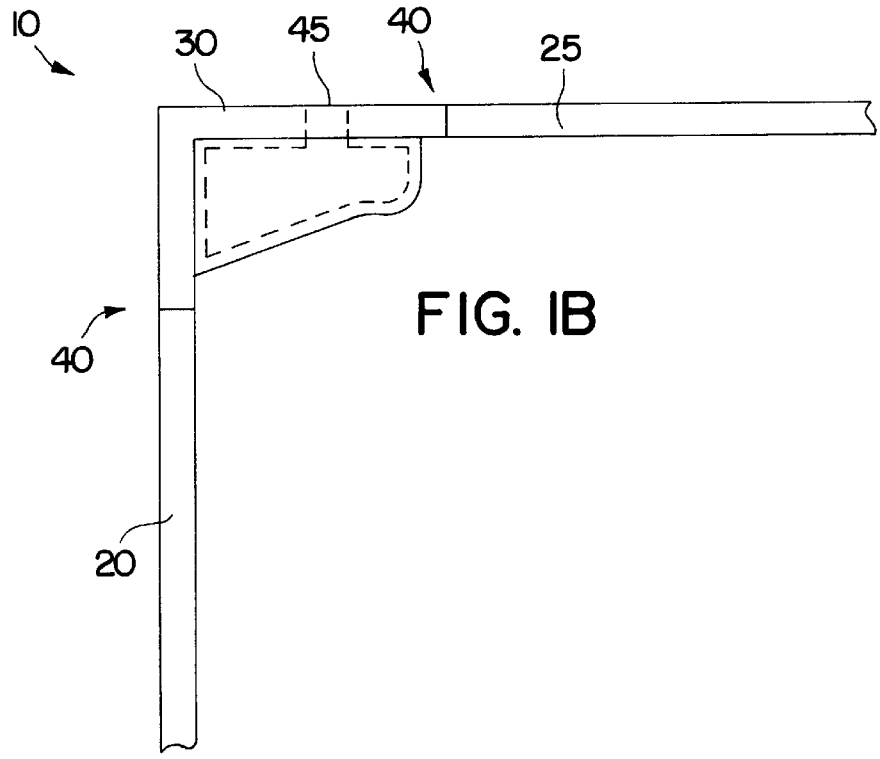
FIG. 1*b* is a fragmentary side elevation of the interior of the domestic container of FIG. 1*a,* showing the exterior of the attachment block, and indicating the interior of the attachment block in broken lines.
Figure 1C:
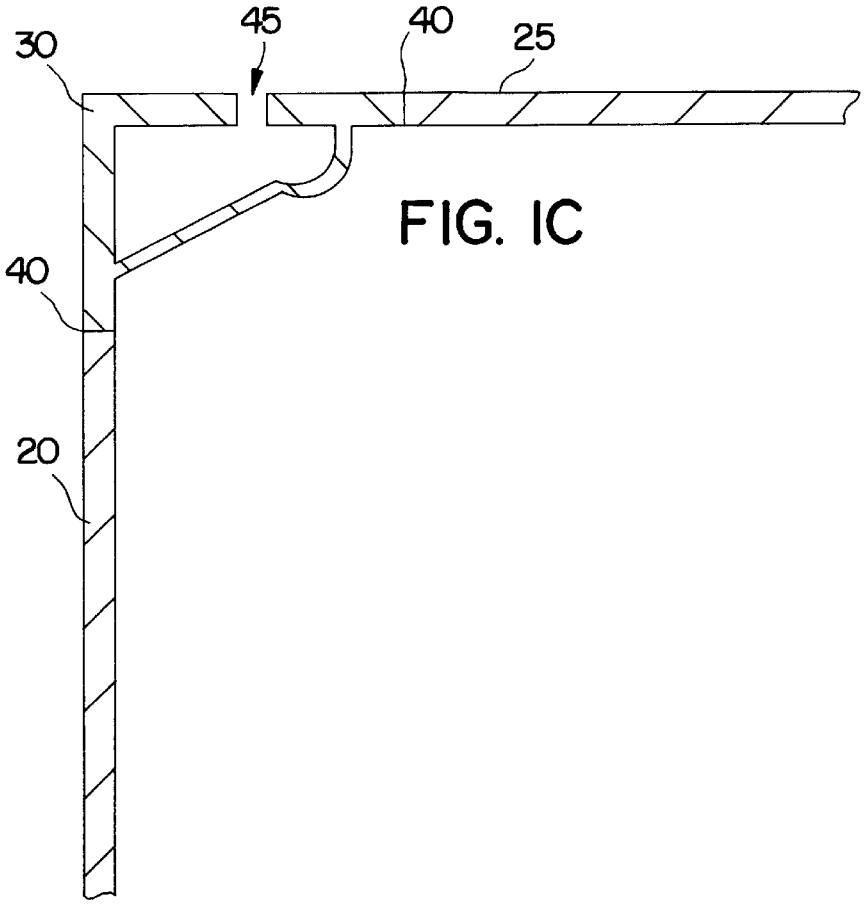
FIG. 1*c* is a fragmentary side elevation, in section, of an attachment block of the domestic container according to FIGS. 1*a* and 1*b,* showing the interior of the attachment block.

While this invention is susceptible of embodiment in many different forms, there is shown herein in the drawings and will be described in detail several specific embodiments, with the understanding that the present disclosure is to be considered as an exemplification of the principles of the invention and is not intended to limit the invention to the embodiments illustrated.

FIG. 1*a* is a perspective view, of a domestic container 10, such as are known and used for the transportation of cargo on railroad cars and on truck trailers. Such domestic containers are manufactured by a number of different makers, including Stoughten of Stoughten, Wis. and HPA of Monon, Ind. Such containers may have a composite construction, with a metal (usually steel) frame, onto which a number of panels are attached, to form the sides, ends, and top and bottom. Inasmuch as the structures of such containers are well known to those of ordinary skill in the art of making, handling, and/or repairing such domestic containers, only those portions of the structure of such a container as are relevant to the subject matter of the present invention will be discussed, and the remaining structure will be understood to be of otherwise conventional configuration.

Typically, within several feet of the ends of such a container 10, frame structures 15 will be provided, which include vertical frame members 20 and horizontal frame members 25. Two vertical frame members are not shown in FIG. 1*a,* but are understood to be connected to horizontal frame members 25, and extend downward along the far side of container 10, out of the line of sight of the viewer of FIG. 1*a.* Attachment blocks 30, connect the vertical frame members 20 and the horizontal frame members 25.

Typically, the vertical and horizontal frame members will be formed as metal (typically steel) tubes. A bottom horizontal frame member, in the form of a tube, may also be provided. Additional framework structures may be provided, to give the container the strength to be self-supporting, when loaded with a mass of cargo, amounting to several times the weight of the empty container. The configuration of such additional framework is known to one of ordinary skill in the art, having the present disclosure before them, and has been omitted from the drawings herein for the sake of clarity of illustration of the invention. A number of panels, e.g., panels 35, may be provided to act as the "skin" of the container. Such panels may be connected to the framework by rivets, etc. in any suitable manner.

Typically, the domestic containers are handled, during loading, stacking, and transfer to and from railroad cars, by large handling cranes or self-propelled loaders, which grasp the containers, using the attachment blocks 30. The attachment blocks 30 typically are connected to the joints where the vertical and horizontal frame members 20, 25 connect. Blocks 30 may even form the actual connection between the vertical and horizontal frame members, and may be connected by welds or other connections 40. Blocks 30 are hollow, and are provided at least with upwardly opening apertures 45. Some blocks 30 may also be provided with horizontally opening apertures (not shown) which may be positioned in the outwardly facing sides of the blocks. The handling devices, the construction and operation of which are known to those skilled in the art, insert hooks into the attachment block apertures, to grasp the container and lift it.

Figure 2:
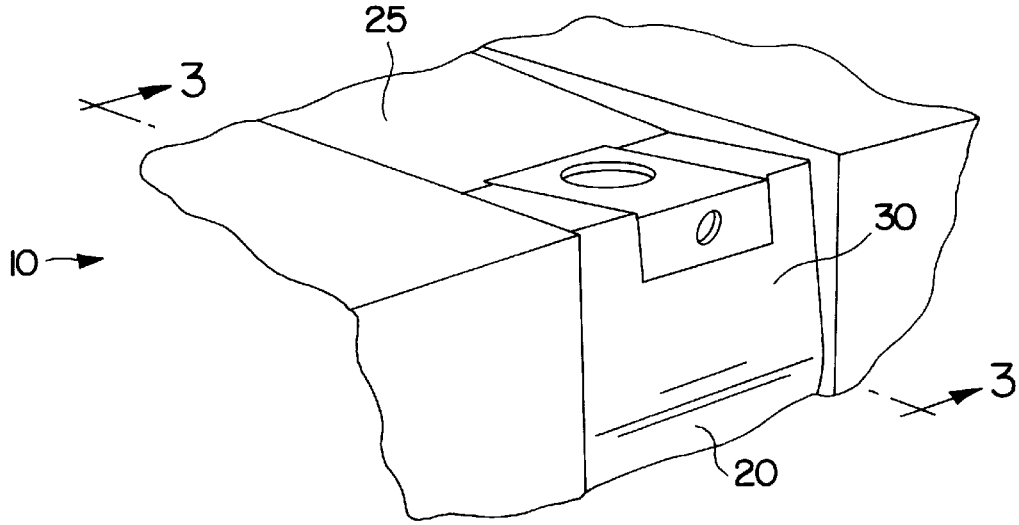
FIG. 2 is a perspective view of an attachment block which has collapsed.
Figure 3:
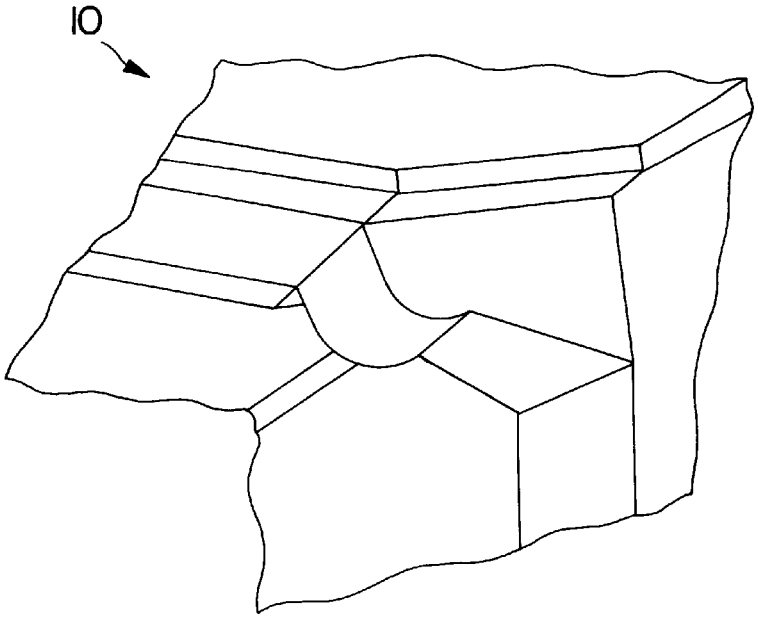
FIG. 3 is a perspective sectional fragmentary view of the attachment block of FIG. 2, showing the interior of the attachment block.

Because the weight of the container, empty or loaded, passes through the (typically) four attachment blocks, the metal of the frame members, to which the attachment blocks are attached, suffers substantial stresses, some of which are bending stresses, which act in the area of the welds 40 which attach the blocks to the adjacent frame members. In addition, typically, the attachment blocks project upwardly, above the remaining surrounding structure of the top of each container. Accordingly, when two containers are stacked, the weight of the upper container is again, concentrated through the blocks and their connections to their surrounding framework. This loading is present whenever one container is mounted on another on a railcar, and the lower car receives a substantial pounding on every trip. The cumulative effect of such treatment is illustrated, somewhat conceptually, in FIGS. 2 and 3, wherein the collapse of a block 30, with respect to its surrounding framework members is shown.

Figure 4:
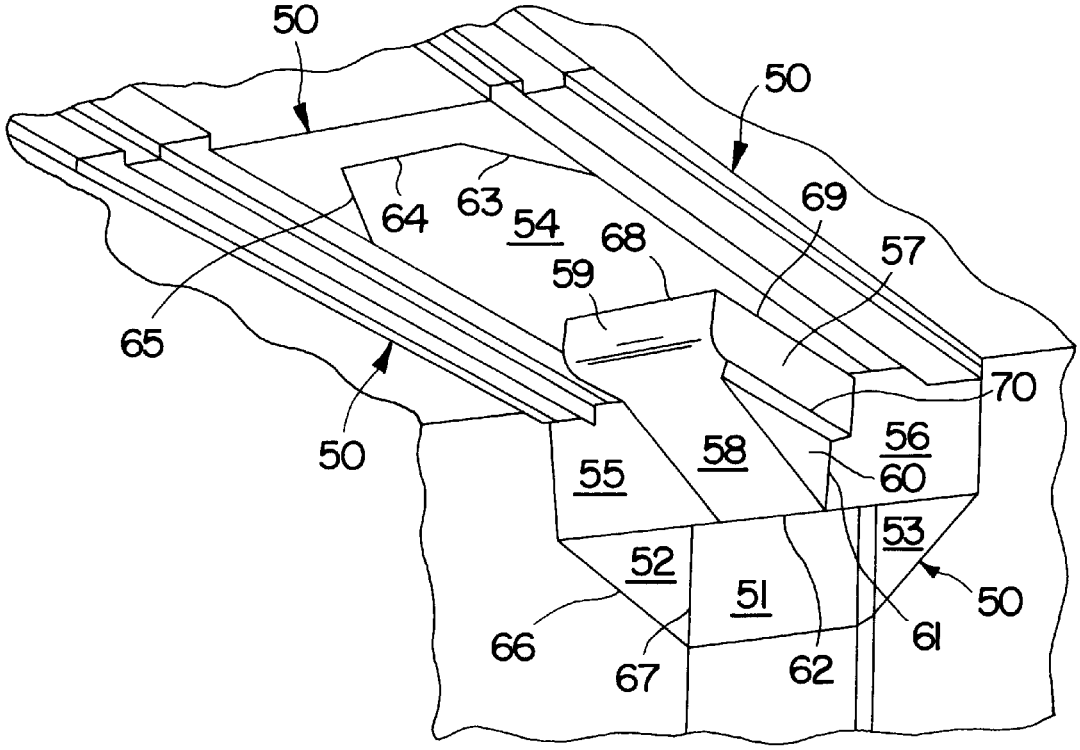
FIG. 4 PRIOR ART
FIG. 4 is an interior perspective view of a domestic container, illustrating one known prior art method of attempting to provide support for the frame structure and attachment block of the container.

One prior art method for restoring function to a container following collapse of the framework surrounding an attachment block is illustrated in FIG. 4. After the damaged block has been levered or jacked (e.g., by hydraulic or screw jack) back into place, the area is cleaned, scraped and/or otherwise prepared for welding, etc., and a metal flashing is overlaid over the entire interior area of the container, surrounding the damaged block and adjacent frame members. This flashing, generally referred to by reference numeral 50, comprises a plurality of separate metal plates 51–60, which are predominantly flat, although some of the plates may be somewhat contoured. Lines 50 indicate the outer periphery of the area covered by the various plates. In order to permit such close fitting of the plates, they must be of relatively thin dimension, relative to their respective lengths and widths. The joints between the plates are formed by welds and brazes, for example welds 61–70, which typically are located where there are large angles between adjoining plates, reflecting the large angles between adjoining surfaces of the underlying framework structures.

One potential drawback of such a support scheme is that substantial loads are required to be borne by the welds connecting the various plates. Over extended use, these welds can weaken, leading to the subsequent further collapse of the attachment block and surrounding framework. Another potential drawback is that the structure and method of FIG. 4 requires a relatively large number of welds, which may be undesirable in terms of time, effort and expense.

Another prior art method for effecting repair of a collapsed container structure (not shown), which may be used in connection with the method shown in FIG. 4, is to overlay, on the outside of the container, over the attachment block and its adjacent horizontal and vertical frame members, a simple L-shaped piece of metal, which is welded into place. A potential drawback of this method is that because the loads which tend to collapse the structure naturally come predominantly from above, downwardly onto the outside of the top of the container, the welds/brazes, etc., which hold the L-shaped member into place must withstand tension forces (particularly, those on the downwardly extending leg of the L-shaped member). In addition, such an L-shaped member does not provide vertical support for the attachment block, but merely augments its connection to the adjacent framework members. Over time, the downwardly directed loads on the attachment block and its overlying L-shaped member may cause the two combined components to pivot, causing the top of the vertically extending framework member to be buckled outwardly, potentially even more than prior to the repair.

It is desirable to provide an apparatus and method for supporting and/or repairing the attachment block structure of a domestic container, which will provide meaningful vertical support to the attachment block, to help the framework structure resist buckling, or in the case of an already collapsed container, restore the container to a functioning, useable condition.

Figure 5:
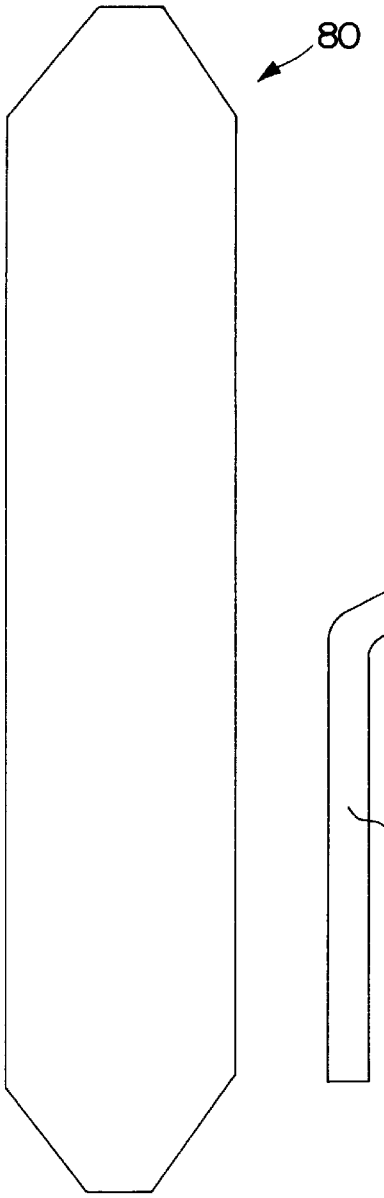
FIG. 5 is a plan view of an unformed blank for a support bracket according to a preferred embodiment of the invention.
Figure 8:
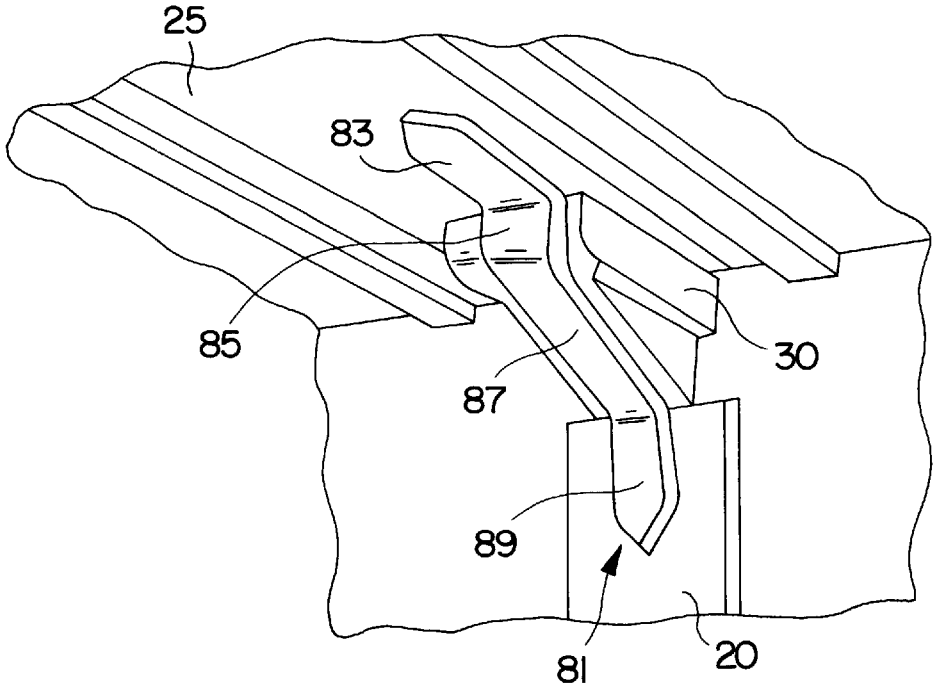
FIG. 8 is an interior perspective view of a domestic container, with a support bracket according to the present invention, installed against the inner, transversely planar surfaces of the horizontal framework member, attachment block and vertical framework member.

A blank for a support bracket 80, according to a preferred embodiment of the present invention is illustrated in FIG. 5. Preferably, the blank is substantially rectangular (although the ends may be tapered as shown), and has a width which is the same or less than the width of the attachment block, as indicated in FIG. 8. For a domestic container having the dimensions generally discussed hereinabove, a suitable blank 80 may have a length on the order of two and one-half feet, a width of about four inches (approximately the transverse width of the underneath surface of the attachment block), and a thickness on the order of three-eighths of an inch. Preferably, the blank will be fabricated from steel.

After the blank has been initially prepared, it is then bent, into a shape (FIG. 6) which conforms to the contour of the attachment block, as would be seen in a side elevation of the interior of the container. Preferably, the bending of the blank is accomplished in such a manner that, after working, the metal in the areas of the bends has not been weakened, relative to the strength of the metal in the unbent areas of the blank.

Figure 6:
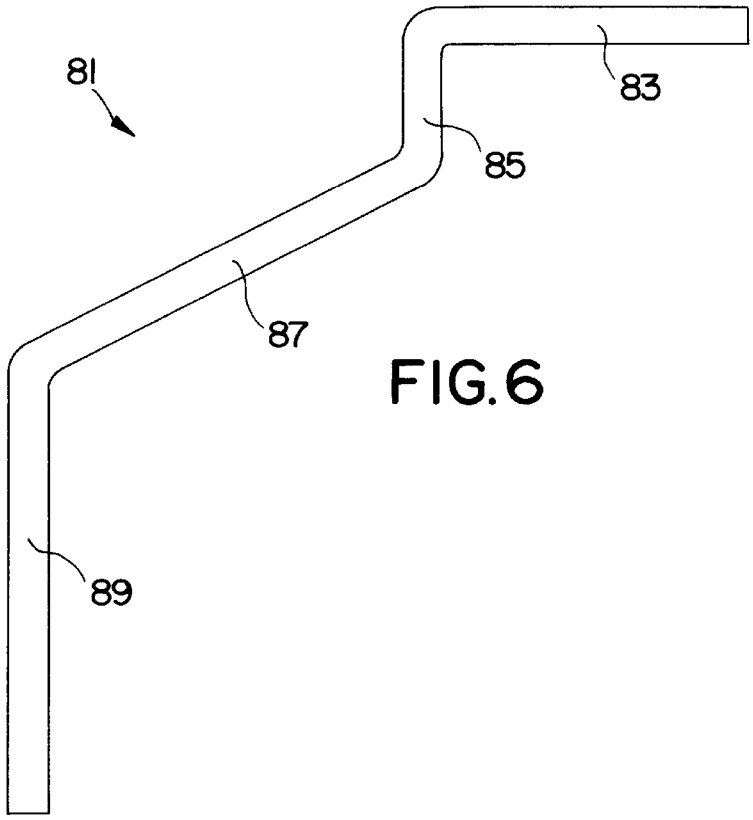
FIG. 6 is a side elevation of a formed support bracket according to a preferred embodiment of the invention.

A typical bracket 81 (formed from blank 80) in accordance with the principles of the present invention will have a configuration as shown in FIG. 6. The bracket 81 typically will have a short horizontal leg 83, a short vertical leg 85, a diagonal leg 85 and a longer vertical leg 89. While it is desirable that the contour of bracket 81 have a shape which substantially follows the surface of the attachment block (and adjacent vertical and horizontal framework members) to which it is to be attached, exact conformity is not required. However, the conformity should be sufficiently close, so that upon final placement of the bracket, substantial portions of the short vertical leg 85 and the diagonal leg 87 make direct supporting contact at all times with the adjacent surfaces of the attachment block.

Figure 7:
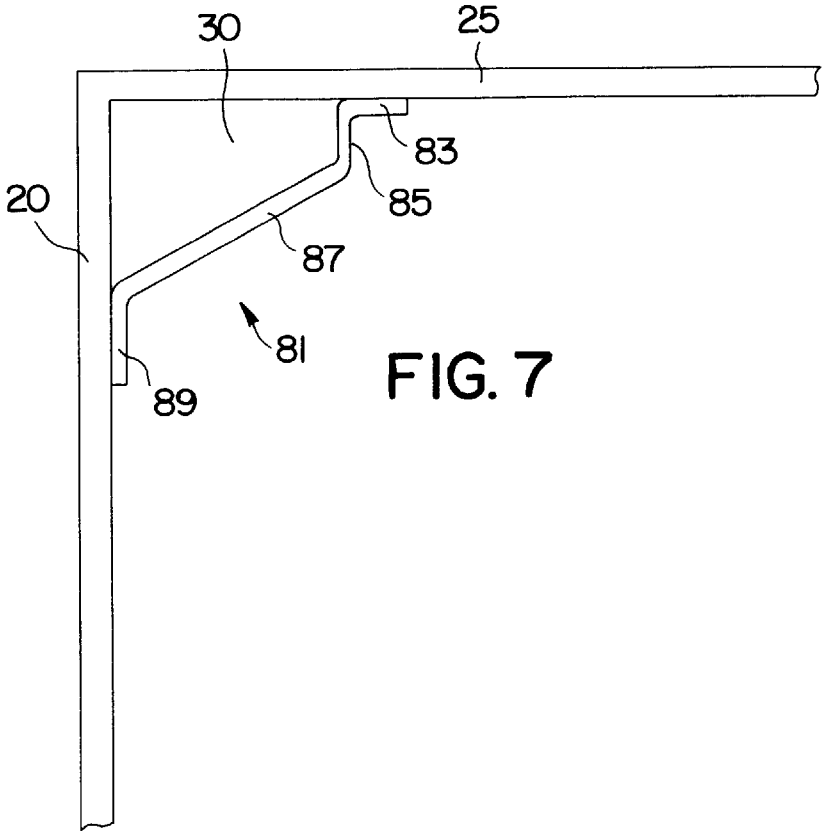
FIG. 7 is a side elevation of the interior of a domestic container, showing the exterior of an attachment block, with a support bracket, according to a preferred embodiment of the invention, in place.

Positioning of bracket 81 is illustrated schematically in FIG. 7. In the case of a repair, the collapsed attachment block and adjacent framework members are levered or jacked back into place, as previously discussed. Short horizontal leg 83 is affixed by any suitable method (e.g., welding) to the underneath surface of the horizontal framework member 25, while the longer vertical leg 89 is similarly affixed to the inside surface of the vertical framework member 20. Leg portions 85 and 87 bear against, and support the attachment block 30. FIG. 8 is an interior perspective view of a domestic container, with a support bracket according to the present invention, installed against the inner, transversely planar surfaces of the horizontal framework member, attachment block and vertical framework member.

Unlike the prior art apparatus and methods which have been discussed, the apparatus and method of the present invention provides support from underneath, which is in the form of a single continuous member, which is believed to help transmit the downwardly directed loads which such a container encounters (when having another container stacked upon it) from the horizontal framework member and the attachment block, downwardly into the vertical framework members. Because the support bracket 81, in preferred embodiments of the invention, is a single, monolithically formed piece of material, uninterrupted by welds, there is believed to be less tendency for the adjoining legs to pivot relative to one another during loading, such as may be expected to be the situation, when a plurality of separate plates are welded to each other and/or to their underlying surfaces. In addition, the support bracket 81 according to the present invention, may serve to "cup" the attachment block, providing vertical support for the entire block, and not just covering it, as in the prior art embodiments.

The method of the present invention is also advantageous in that it employs a less complex, and less costly structure, involving fewer welds.

While a generalized shape for the attachment block has been shown and described in the present invention, and a particular contour for the support bracket has been shown, it is to be understood that the side contours of the support bracket may be modified, in order to fit the attachment block of a particular application, by one of ordinary skill in the art, having the present disclosure before them, without departing from the scope of the invention.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A support bracket for a domestic railroad cargo container, wherein the container is of the type having a substantially rectangular parallelepiped configuration, with a top wall, a bottom wall, two end walls and two side walls, the container further having at least one attachment block operably configured for engagement by a container handling apparatus, to enable the container to be manipulated by the container handling apparatus, the container further including at least one horizontal framework member and at least one vertical framework member disposed in a substantially intersecting relationship therewith, the at least one attachment block being operably disposed substantially adjacent the top wall of the container at the intersection of the at least one horizontal framework member and the at least one vertical framework member, the support bracket comprising:

a horizontal attachment leg, operably configured to be affixed to and against an inwardly-facing surface of the at least one horizontal framework member of a container;

a vertical attachment leg, operably configured to be affixed to and against an inwardly-facing surface of the at least one vertical framework member of a container;

at least one intermediate leg, operably configured to substantially conform to an inwardly-facing surface contour of an attachment block of a container, the at least one intermediate leg operably connecting the horizontal and vertical attachment legs;

each of the horizontal, vertical and at least one intermediate legs being substantially planar in their respective transverse dimensions;

the horizontal, vertical and at least one intermediate legs being further operably configured to substantially resist pivoting of any leg relative to any other leg, so that the bracket is configured to resist and push against downward vertical loads exerted on the horizontal leg by a horizontal framework member.

2. The support bracket according to claim 1, wherein the horizontal, vertical and at least one intermediate legs are formed from a single substantially rectangular blank of metal, which is bent into shape.

3. A method for repairing a domestic railroad cargo container, wherein the container is of the type having a substantially rectangular parallelepiped configuration, with a top wall, a bottom wall, two end walls and two side walls, the container further having at least one attachment block operably configured for engagement by a container handling apparatus, to enable the container to be manipulated by the container handling apparatus, the container further including at least one horizontal framework member and at least one vertical framework member disposed in substantially intersecting relationship therewith, the at least one attachment block being operably disposed substantially adjacent the top wall of the container at the intersection of the at least one horizontal framework member and the at least one vertical framework member, wherein at least one of the attachment block and the at least one horizontal and at least one vertical framework member have collapsed, the method comprising the steps of:

temporarily repositioning the collapsed at least one of the attachment block and the at least one horizontal and at least one vertical framework members to an original uncollapsed configuration;

preparing inner surfaces of the attachment block and the at least one horizontal and at least one vertical framework members for metalworking processes;

positioning a support bracket against inside surfaces of the attachment block and the at least one horizontal and at least one vertical framework members; and substantially permanently affixing the support bracket against the inside surfaces of the attachment block and the at least one horizontal and at least one vertical framework members, wherein the support bracket is provided with a horizontal attachment leg, operably configured to be affixed to and against an inwardly-facing surface of the at least one horizontal framework member of a container;

a vertical attachment leg, operably configured to be affixed to and against an inwardly-facing surface of the at least one vertical framework member of a container;

at least one intermediate leg, operably configured to substantially conform to an inwardly-facing surface contour of an attachment block of a container;

at least one intermediate leg, operably configured to substantially conform to an interior surface contour of an attachment block of a container, the at least one intermediate leg operably connecting the horizontal and vertical attachment legs;

each of the horizontal, vertical and at least one intermediate legs bring substantially planar in their respective transverse dimensions;

the horizontal, vertical and at least one intermediate legs being further operably configured to substantially resist pivoting of any leg relative to any other leg, so that the bracket is configured to resist and push against downward vertical loads exerted on the horizontal leg by a horizontal framework member.

* * * * *